US007192363B2

(12) United States Patent
Blankenship

(10) Patent No.: US 7,192,363 B2
(45) Date of Patent: Mar. 20, 2007

(54) GOLF CLUB HEAD WITH A VARIABLY DAMPENED FACE

(75) Inventor: Jeffrey A. Blankenship, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 273 days.

(21) Appl. No.: 10/969,453

(22) Filed: Oct. 19, 2004

(65) Prior Publication Data

US 2006/0084522 A1 Apr. 20, 2006

(51) Int. Cl.
*A63B 53/04* (2006.01)
*A63B 53/08* (2006.01)

(52) U.S. Cl. ..... 473/326; 473/329; 473/332; 473/333

(58) Field of Classification Search ..... 473/324–350, 473/244–247

See application file for complete search history.

(56) References Cited

U.S. PATENT DOCUMENTS

| | | | | | |
|---|---|---|---|---|---|
| 769,939 | A * | 9/1904 | Clark | ..... | 473/329 |
| 925,389 | A * | 6/1909 | Royce | ..... | 473/329 |
| 1,039,491 | A * | 9/1912 | Collins | ..... | 473/233 |
| 2,111,249 | A * | 3/1938 | Plese | ..... | 473/233 |
| 5,064,197 | A * | 11/1991 | Eddy | ..... | 473/326 |
| 5,505,453 | A * | 4/1996 | Mack | ..... | 473/329 |
| 6,299,547 | B1 * | 10/2001 | Kosmatka | ..... | 473/329 |
| 6,354,956 | B1 * | 3/2002 | Doong | ..... | 473/219 |

* cited by examiner

*Primary Examiner*—Sebastiano Passaniti
(74) *Attorney, Agent, or Firm*—Darrell F. Marquette

(57) ABSTRACT

A golf club head includes a body having a front surface, a back surface, a heel end, a toe end, a sole extending between lower portions of the heel and the toe ends, and a top rail extending between upper portions of the heel and toe ends. A face is coupled to the body through a rheological fluid. The golf club head is tuned by changing the viscosity of the rheological fluid.

13 Claims, 3 Drawing Sheets

GOLF CLUB HEAD WITH A VARIABLY DAMPENED FACE

BACKGROUND OF THE INVENTION

The present invention relates, in general, to golf equipment and, more particularly, to a golf club head with a variably dampened face.

An important factor governing the distance and accuracy of a golfer's drive is the amount of energy transferred from the golf club head to a golf ball when it impacts the golf ball. Ideally, the point of impact on the face of the golf club head is below the center of gravity of the golf club head and the point of impact on the golf ball is below the center of gravity of the golf ball. In addition, the theoretical plane containing the impact point on the golf club head, the center of gravity of the golf club head, and the center of gravity of the golf ball should be in alignment with the intended travel path of the golf ball. When these conditions are met, the golf club head is properly aligned and produces maximum face response characteristics.

To help golfers achieve proper alignment, golf club manufacturers have concentrated a relatively large mass of the golf club head in its sole. This configuration has made it easier for a golfer to place the center of gravity of the golf club head below the center of gravity of the golf ball; however it is still difficult for a golfer to achieve perfect alignment. For example, a golfer may have the club head square immediately prior to impact, but the actual point of impact with the club head may be shifted from the desired point on the club head to either the heel end or the toe end. This results in improper alignment because the club head becomes twisted to an out of square position and results in less than the maximum amount of energy being transferred to the golf ball. The terms twisting, twisted, or gyration are used here to define a rotation of the club head at the time of impact about an axis which passes through the center of gravity of the club head and is parallel to the axis of the golf club shaft. To dampen or reduce the effects caused by twisting of the club head, golf club manufacturers have placed relatively large concentrations of mass in the heel and toe of the club head to increase the moment of inertia and thereby maximize the energy transfer from the club head to the golf ball. Although these techniques have improved the ability of the golfer to increase the consistency with which they properly align the golf club, slight misalignment of the golf club head results in less than optimum face response characteristics.

Accordingly, what is needed is a golf club head, a method of manufacturing the golf club head, and a method for tuning the golf club head that permits adjusting the face response characteristics of the golf club head.

SUMMARY OF THE INVENTION

The present invention provides a golf club head, in accordance with one aspect, comprising a body with a front surface, a back surface, a heel end, a toe end, and a sole extending between lower portions of the heel and toe ends. A top rail extends between upper portions of the heel and toe ends, and a face is elastically coupled to the front surface of the body.

In accordance with another aspect, the present invention comprises a golf club head including a body having a front surface, a back surface, a heel end, a toe end, a face plate and a dampening structure. The face plate is adjustably coupled to the body through the dampening structure.

DESCRIPTION OF THE DRAWINGS

The present invention will be better understood from a reading of the following detailed description, taken in conjunction with the accompanying drawing figures, in which like reference numbers designate like elements and in which.

DESCRIPTION OF THE INVENTION

Generally, the present invention provides a method and structure for adjusting the face response characteristics of a golf club head. As those skilled in the art are aware, the portion of the golf club head that makes contact with the golf ball is commonly referred to as the face. A golf club head in accordance with the present invention comprises a face that is separate and spaced apart from the body of the golf club head. The body has dampening structures comprising a Theological fluid that can be tuned using a magnetic or electric flux. When the rheological fluid interacts with a magnetic field from a magnet, the rheological fluid becomes either more viscous or less viscous. The desired viscosity is selected in accordance with a golfer's desired face response characteristics. Once selected, the source of the magnetic field is fixed in place, thereby setting the viscosity. Thus, the face is tunably coupled to the body.

Figure 3:
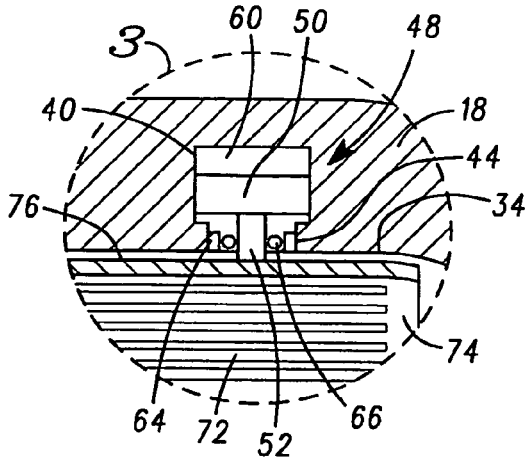
FIG. 3 is an expanded view of the portion of the iron-type golf club head enclosed within the circle indicated by broken line 3 shown in FIG. 2.
Figure 1:
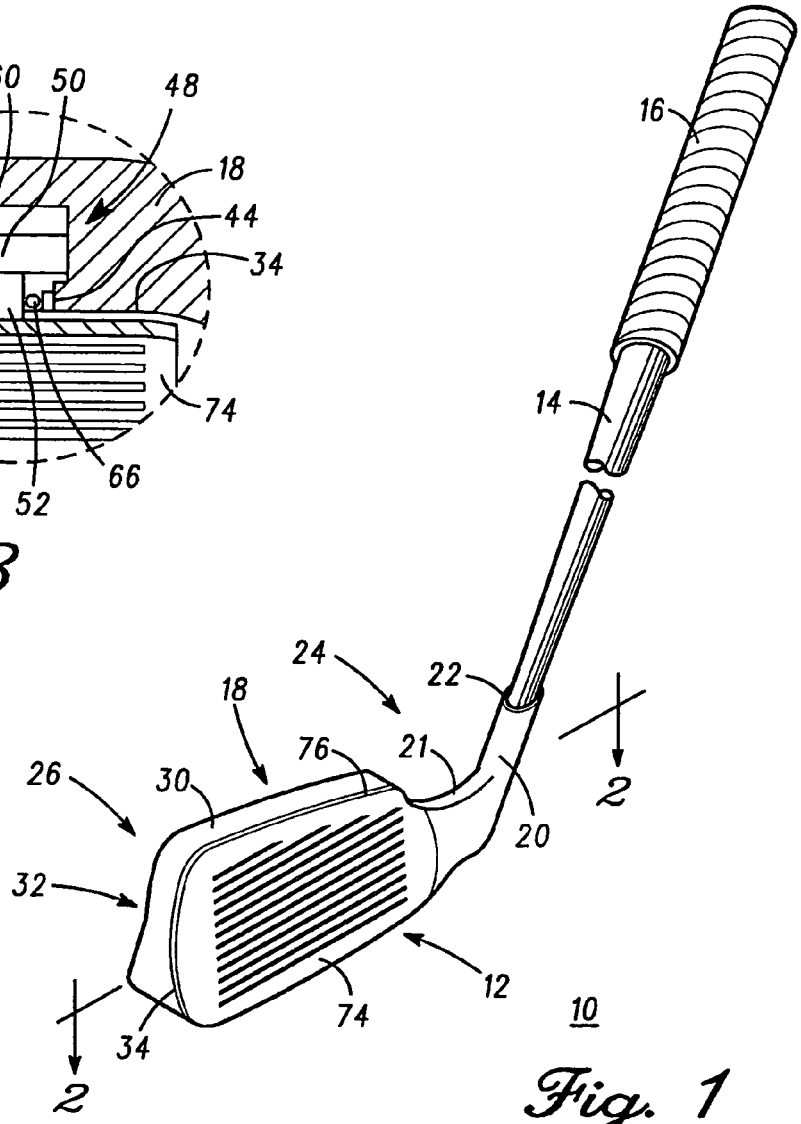
FIG. 1 illustrates golf club including an iron-type golf club head in accordance with an embodiment of the present invention.
Figure 2:
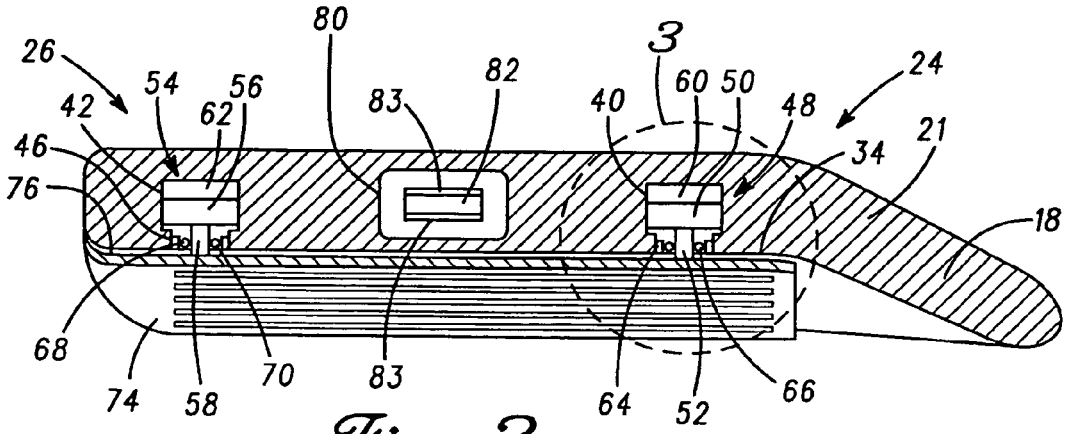
FIG. 2 illustrates a cross-sectional top view of the iron-type golf club head of FIG. 1.
Figure 4:
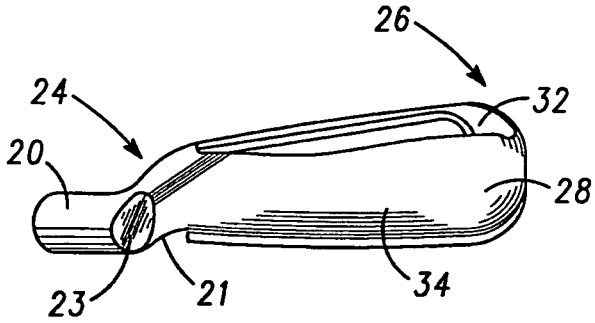
FIG. 4 illustrates a bottom view of the iron-type golf club head of FIGS. 1 and 2.

FIGS. 1, 2, 3, and 4 depict various views of a golf club in accordance with an embodiment of the present invention. For the sake of clarity, FIGS. 1–4 are described contemporaneously with each other rather than sequentially. Briefly, FIG. 1 illustrates a golf club 10 including an iron-type golf club head 12 and golf club shaft 14; FIG. 2 illustrates a cross-sectional top view of iron-type golf club head 12; FIG. 3 illustrates an expanded view of the portion of iron-type golf club head 12 encircled by broken line 3 in FIG. 2; and FIG. 4 illustrates a bottom view of iron-type golf club head 12. Iron-type golf club head 12 is coupled to one end of the golf club shaft 14 and a grip 16 is coupled to an opposing end of golf club shaft 14. Suitable materials for golf club shaft 14 include steel and graphite. Although golf club head 12 is shown as an iron-type golf club head, it could also be a putter or a wood-type club head.

Iron-type golf club head 12 includes a body 18 and a hosel 20, which has a cylindrical bore 22 for receiving one end of golf club shaft 14 (shown in FIG. 1). Body 18 has a heel end 24 spaced apart from a toe end 26. A sole 28 (shown in FIG. 4) extends from a lower portion of heel end 24 to a lower portion of toe end 26 and a top rail 30 (shown in FIG. 1) extends from an upper portion of heel end 24 to an upper portion of toe end 26. Body 18 has a back surface 32 that extends between heel end 24 and toe end 26 along a back or rear portion of body 18. Body 18 further includes a front surface 34 that extends between heel end 24 and toe end 26. Hosel 20 includes a neck 21 connected to heel end 24 of body 18. Neck 21 has a notch 23 (shown in FIG. 4) in the lower surface of neck 21. Club head 12 may be formed by casting, machining from solid castings, or the like. Suitable materials for club head 12 include, but are not limited to, stainless steel, titanium, aluminum, nickel, alloys of titanium, alloys of aluminum, alloys of nickel, and the like.

T-shaped piston cavities 40 and 42 having openings 44 and 46 and sidewalls, respectively, extend from front surface 34 into body 18. Piston cavities 40 and 42 can be formed by techniques such as, for example, molding, machining, and the like. A piston assembly 48 comprising a piston 50 coupled to a piston rod 52 is positioned in piston cavity 40 and a piston assembly 54 comprising a piston 56 coupled to a piston rod 58 is positioned in piston cavity 42. Piston rods 52 and 58 may include protrusions (not shown) extending perpendicularly from rods 52 and 58 which impinge on the flow of fluid in cavities 40 and 42, respectively. Magneto-rheological fluid (MRF) 60 is placed in piston cavity 40 and magneto-rheological fluid (MRF) 62 is placed in piston cavity 42. Optionally, piston assemblies 48 and 54 include openings (not shown) to facilitate the flow of magneto-rheological fluid 60 and 62 in cavities 40 and 42, respectively. Typically magneto-rheological fluids are composed of three components: a carrier fluid, magnetic particles, and additives. The carrier fluid acts as the medium for the other components. Suitable media for the carrier fluid include, for example, silicone oil, hydrocarbon fluid, and mineral oils. The particles are ferrous in nature and therefore become polarized in the presence of a magnetic field. The polarization changes the viscosity of the magneto-rheological fluid. The additives are used to provide stability to the mixture, corrosion control, and lubrication and include anti-oxidants, pH shifters, dyes and pigments, salts, and deacidifiers. Suitable magneto-rheological fluids are known to those skilled in the art. Alternatively, a magneto-rheological gel or an electro-rheological fluid can be used in place of the magneto-rheological fluid.

Opening 44 is sealed with an end cap 64 and O-ring assembly 66 and opening 46 is sealed with an end cap 68 and O-ring assembly 70. The mechanism for sealing openings 44 and 46 is not a limitation of the present invention. Other sealing mechanisms that prevent leakage of magneto-rheological fluid from piston cavities 40 and 42, prevent air from entering piston cavities 40 and 42, and align piston rods 52 and 58 may be used.

A golf club face plate 72 having a front surface 74 and a back surface 76 is attached to piston rods 52 and 58. Front surface 74 forms a face of golf club head 12 and is designed for impacting a golf ball. Techniques for attaching piston rods 52 and 58 include welding or brazing. Alternatively, an adhesive may be applied to the ends of piston rods 52 and 58, or to the portions of back surface 76 that mate with piston rods 52 and 58, or to the ends of piston rods 52 and 58 and to back surface 76. After applying the adhesive, piston rods 52 and 58 are bonded to back surface 76. In another alternative, piston rods 52 and 58 may be attached to golf club face plate 72 using one or more set screws. In yet another alternative, piston rods 52 and 58 may be attached to golf club face plate 72 by threading the ends of piston rods 52 and 58, forming threaded grooves in golf club face plate 72, and screwing rods 52 and 58 into the threaded grooves. It should be understood the technique for attaching piston rods 52 and 58 to golf club face plate 72 is not a limitation of the present invention.

A cavity 80 is formed in body 18 and a magnet 82 is placed in cavity 80. Similar to cavities 40 and 42, cavity 80 may be formed using techniques such as, for example, casting, machining, and the like. Preferably, magnet 82 has a ferrite shield 83 and is capable of being oriented in different directions by application of an external magnetic field. Once the desired orientation has been achieved, magnet 82 is maintained in this orientation. For example, an adhesive can be used to hold the magnet in place. Alternatively, magnet 82 may be placed on a movable fixture (not shown) which is coupled to, for example, a dial on the golf club head. Thus, a golfer can adjust the viscosity of the magneto-rheological fluid by turning the dial. Selecting the desired orientation of the magnet and fixing it in that orientation is referred to as tuning or programming the golf club. Magnet 82 creates a magnetic field that interacts with magneto-rheological fluids 60 and 62 and changes their viscosities. Thus, magnet 82 can be oriented to either increase or decrease the strength of the magnetic field that interacts with magneto-rheological fluids 60 and 62. In accordance with one embodiment, the viscosities of magneto-rheological fluids 60 and 62 are selected such that they are the same after tuning with magnet 82. In accordance with another embodiment, magneto-rheological fluid 60 is selected to be of higher viscosity than magneto-rheological fluid 62 after tuning with magnet 82. In accordance with yet another embodiment, magneto-rheological fluid 62 is selected to be of higher viscosity than magneto-rheological fluid 60 after tuning with magnet 82. The viscosities of the magneto-rheological fluids are not limitations of the present invention.

In operation, magneto-rheoligical fluids 60 and 62 are tuned to have a desired viscosity by orienting magnet 82 so that the strength of the portion of its magnetic field that interacts with magneto-rheological fluids 60 and 62 causes magneto-rheological fluids 60 and 62 to have the desired viscosity. More particularly, magnet 82 may be oriented to increase or decrease the magnetic field applied to magneto-rheological fluids 60 and 62, which in turn increases or decreases their viscosities. Thus, the clubface response characteristics of each golf club can be adjusted or tuned to those desired by the individual golfer. For example, golfers may find that adjusting magnet 82 to increase the viscosity of magneto-rheological fluids 60 and 62 improves the distance and accuracy of their shots. In an embodiment in which magnet 82 is coupled to a dial, the golfer can adjust the viscosities by turning the dial. Once the viscosities are tuned, magnet 82 is fixed in place to set the desired clubface response characteristics. Cavities 44 and 46 cooperate with end caps 64 and 68, O-ring assemblies 66 and 70, piston assemblies 48 and 54, and magneto-rheological fluids 60 and 62 to form a shock absorber structure, which allows tuning or adjusting the shock absorber of golf club head 12. Thus, golf club head 12 has a body 18 to which golf club face plate 72 having club face 74 is elastically or tunably coupled.

Figure 5:
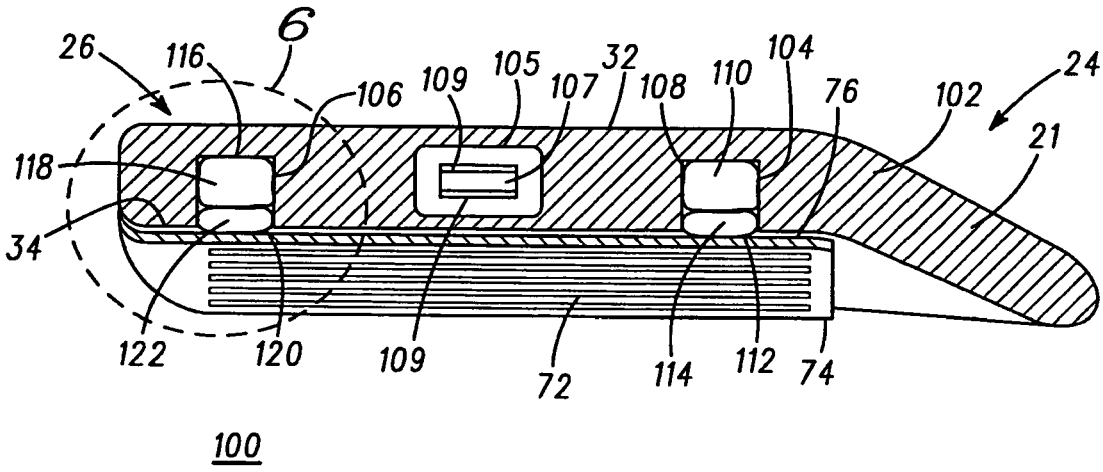
FIG. 5 illustrates a cross-sectional top view of an iron-type golf club head in accordance with another embodiment of the present invention.
Figure 6:
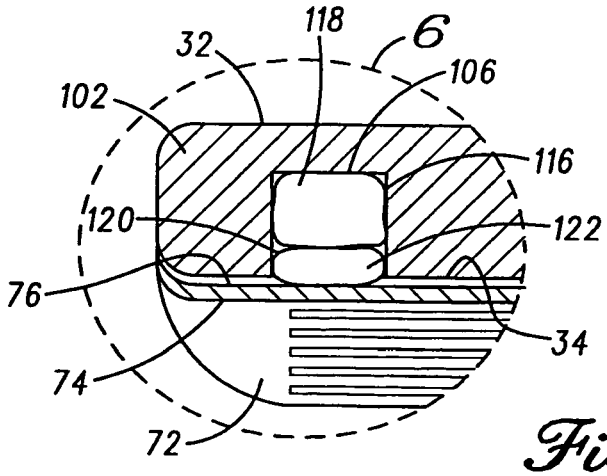
FIG. 6 is an expanded view of the portion of the iron-type golf club head enclosed within the circle indicated by broken line 6 shown in FIG. 5.

FIGS. 5 and 6 depict views of a golf club in accordance with another embodiment of the present invention. For the sake of clarity, FIGS. 5 and 6 are described contemporaneously with each other rather than sequentially. Briefly, FIG. 5 is a cross-sectional top view of iron-type golf club head 100 in accordance with another embodiment of the present invention. FIG. 6 illustrates an expanded view of the portion of iron-type golf club head 100 encircled by broken line 6 in FIG. 5. Like iron-type golf club head 12, iron-type golf club head 100 includes a body and hosel 20 having a cylindrical bore 22 for receiving one end of golf club shaft 14. Because the cavities formed in the body of club head 100 have a different shape than the cavities formed in the body of club head 12, the body of club head 12 is identified by reference number 102. Body 102 includes heel end 24, toe end 26, sole 28, top rail 30, back surface 32, and front surface 34. Club head 100 may be formed by casting, machining from solid castings, or the like. Suitable materials for club head 12 include, but are not limited to, stainless steel, titanium, aluminum, nickel, alloys of titanium, alloys of aluminum, alloys of nickel.

Cavities 104 and 106 are formed in body 102. Although cavities 104 and 106 are shown as being U-shaped, the shape of cavities 104 and 106 is not a limitation of the present invention. A sealable, collapsible bag 108 containing magneto-rheological fluid 110 is placed in cavity 104 and a sealable, collapsible bag 112 also containing a magneto-rheological fluid 114 is placed on or over sealable bag 108. Alternatively, bags 108 and 112 may be sealable collapsible balloons. The viscosity of magneto-rheological fluids 110 and 114 may be the same or different depending on the desired amount of dampening it will give to golf club face 74. A sealable bag 116 containing magneto-rheological fluid 118 is placed in cavity 106 and a sealable bag 120 also containing a magneto-rheological fluid 122 is placed on or over sealable bag 116. The viscosity of magneto-rheological fluids 118 and 120 may be the same or different depending on the desired amount of dampening. Further, the viscosity of magneto-rheological fluids 110, 114, 118, and 122 may be the same as or different from each other. The number of sealable bags 108, 112, 116, and 120 is not a limitation of the present invention. Thus, a single sealable bag, two sealable bags, or more than two sealable bags may be associated with each cavity 104 and 106. Preferably, sealable bags 108, 112, 116, and 120 are made from an elastic material that is impermeable to magneto-rheological fluid. It should be understood that the material filling the sealable bags is not limited to a magneto-rheological fluid. Other suitable rheological materials include magneto-rheological gels, electro-rheological fluids, and the like.

Sealable bag 108 is attached to a bottom portion of cavity 104 using an adhesive and sealable bag 112 is attached to sealable bag 108 using an adhesive. Sealable bag 116 is attached to a bottom portion of cavity 106 using an adhesive and sealable bag 120 is attached to sealable bag 116 using an adhesive. Although it is preferable that the adhesives used for attaching or bonding be the same, this is not a limitation of the present invention, i.e., they may be different.

A cavity 105 is formed in body 102 and a magnet 107 is placed in cavity 105. Like magnet 82, magnet 107 preferably has a ferrite shield 109 and is capable of being oriented in different directions by application of an external magnetic field. Magnet 107 creates a magnetic field that interacts with magneto-rheological fluids 110, 114, 118, and 122 and changes their viscosities. Thus, magnet 107 can be oriented to either increase or decrease the strength of the portion of the magnetic field that interacts with magneto-rheological fluids 110, 114, 118, and 122, which in turn increases or decreases their viscosities. In accordance with one embodiment, the viscosities of magneto-rheological fluids 110, 114, 118, and 122 are selected such that they are the same after tuning with magnet 107. In accordance with another embodiment, magneto-rheological fluids 110 and 114 are selected to be of higher viscosity than magneto-rheological fluids 118 and 122 after tuning with magnet 107. In accordance with yet another embodiment, magneto-rheological fluids 118 and 122 are selected to be of higher viscosity than magneto-rheological fluids 110 and 114 after tuning with magnet 107. In accordance with yet another embodiment, magneto-rheological fluids 110 and 118 are selected to be of higher viscosity than magneto-rheological fluids 114 and 122 after tuning with magnet 107. It should be understood that the combination of viscosities of the magneto-rheological fluids is not a limitation of the present invention. For example, among other combinations, magneto-rheological fluids 114 and 122 are selected to be of higher viscosity than magneto-rheological fluids 110 and 118 after tuning with magnet 107.

A golf club face plate 72 having a front surface 74 for impacting a golf ball and a back surface 76 is attached to sealable bags 112 and 120. More particularly, sealable bags 112 and 120 are attached to back surface 76 using an adhesive.

In operation, magneto-rheoligical fluids 110, 114, 118, and 122 are tuned to have a desired viscosity by orienting the direction of the magnetic field emanating from magnet 107. Magnet 107 may be oriented to increase or decrease the magnetic field applied to magneto-rheological fluids 110, 114, 118, and 122, which in turn increases or decreases their viscosities. Thus, the clubface response characteristics of each golf club can be adjusted or tuned to those desired by the individual golfer. For example, a golfer may find that adjusting magnet 107 to increase the viscosity of magneto-rheological fluids 110 and 114 and to decrease the viscosity of magneto-rheological fluids 118 and 122 improves the distance and accuracy of that golfer's shots. Once the viscosities are tuned, magnet 107 is fixed in place to set the desired clubface response characteristics.

Figure 7:
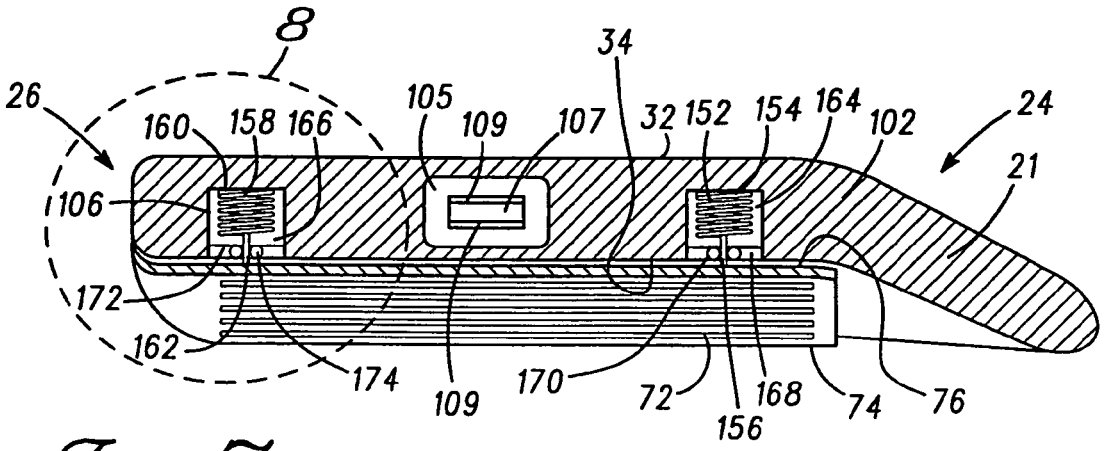
FIG. 7 illustrates a cross-sectional top view of an iron-type golf club head in accordance with yet another embodiment of the present invention.
Figure 8:
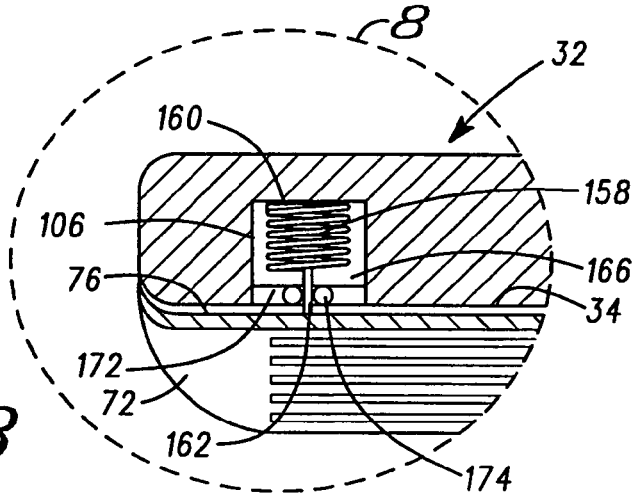
FIG. 8 is an expanded view of a portion of the iron-type golf club head enclosed within the circle indicated by broken line 8 shown in FIG. 7.

FIGS. 7 and 8 depict views of a golf club in accordance with yet another embodiment of the present invention. For the sake of clarity, FIGS. 7 and 8 are described contemporaneously with each other rather than sequentially. Briefly, FIG. 7 is a cross-sectional top view of iron-type golf club head 150 in accordance with another embodiment of the present invention. FIG. 8 illustrates an expanded view of the portion of iron-type golf club head 150 encircled by broken line 8 in FIG. 7. Like iron-type golf club head 100, iron-type golf club head 150 includes body 102 and hosel 20 having cylindrical bore 22 for receiving one end of golf club shaft 14. Body 102 includes heel end 24, toe end 26, sole 28, top rail 30, back surface 32, and front body surface 34. Club head 150 is preferably cast from stainless steel. Body 102 also has cavities 104, 105, and 106 and a magnet 107 having a ferrite shield 109. Hosel 20 includes a neck 21 connected to heel end 24 of body 102. A spring 152 having ends 154 and 156 is attached to the bottom of cavity 104 and a spring 158 having ends 160 and 162 is attached to the bottom of cavity 106. Preferably, ends 154 and 160 include a coiled portion for attachment to the bottoms of cavities 104 and 106, respectively, whereas ends 156 and 162 are straight portions for attachment to back surface 76 of face plate 72. A magneto-rheological fluid 164 is placed in cavity 104 and magneto-rheological fluid 166 is placed in cavity 106. Cavity 104 is sealed with an end cap 168 and O-ring assembly 170 and cavity 106 is sealed with an end cap 172 and O-ring assembly 174. The mechanism for sealing cavities 104 and 106 is not a limitation of the present invention. Other sealing mechanisms that prevent leakage of magneto-rheological fluid from cavities 104 and 106, prevent air from entering cavities 104 and 106, and align ends 156 and 162 may be used.

In operation, magneto-rheoligical fluids 164 and 166 are tuned to have a desired viscosity by orienting the direction of the magnetic field from magnet 107. More particularly, magnet 107 may be oriented to increase or decrease the magnetic field applied to magneto-rheological fluids 164 and 166, which in turn increases or decreases their viscosities. Changing the viscosities of magneto-rheological fluids 164 and 166 effectively changes the spring constants of springs 152 and 158, respectively. Thus, the clubface response characteristics of each golf club can be adjusted or tuned to those desired by the individual golfer. For example, a golfer may find that adjusting magnet 107 to increase the viscosity of magneto-rheological fluids 164 and 166 improves the distance and accuracy of their shots. Once the viscosities are tuned, magnet 107 is fixed in place to set the desired clubface response characteristics.

Figure 9:
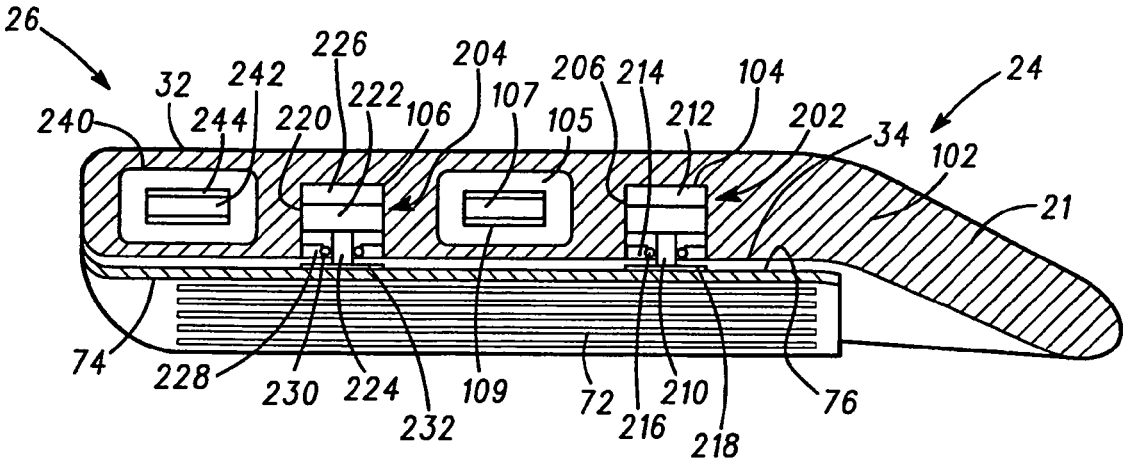
FIG. 9 illustrates a cross-sectional top view of an iron-type golf club head in accordance with yet another embodiment of the present invention.

Referring now to FIG. 9, a cross-sectional top view of iron-type golf club head 200 in accordance with another embodiment of the present invention is illustrated. Like iron-type golf club heads 100 and 150, iron-type golf club head 200 includes body 102 and hosel 20 having cylindrical bore 22 for receiving one end of golf club shaft 14. Body 102 includes heel end 24, toe end 26, sole 28, top rail 30, back surface 32, and front surface 34. Hosel 20 includes a neck 21 connected to heel end 24 of body 102. Club head 200 is preferably cast from stainless steel. Body 102 also has cavities 104 and 106. A piston assembly 202 is coupled to cavity 104 and a piston assembly 204 is coupled to cavity 106. Piston assembly 202 comprises a cylindrical vessel 206 containing a piston 208 having a piston rod 210 coupled thereto. Cylindrical vessel 206 also contains a magneto-rheological fluid 212. Cylindrical vessel 206 is sealed with an end cap 214 and an O-ring assembly 216. Piston rod 210 extends through O-ring assembly 216 and protrudes from front surface 34. Optionally, a coupling plate 218 is mounted to the exposed end of piston rod 210. Coupling plate 218 may be welded or adhesively attached to back surface 76 of golf club face plate 72. Alternatively and similarly to golf club head 12, piston rod 210 can be adhesively bonded to golf club face plate 72, or threaded and screwed into threaded grooves in golf club face plate 72, or attached using set screws.

Piston assembly 204 comprises a cylindrical vessel 220 containing a piston 222 having a piston rod 224 coupled thereto. Cylindrical vessel 220 also contains a magneto-Theological fluid 226. Cylindrical vessel 220 is sealed with an end cap 228 and an O-ring assembly 230. Piston rod 224 extends through O-ring assembly 230 and protrudes from front surface 34. Optionally, a coupling plate 232 is mounted to the exposed end of piston rod 224. Coupling plate 232 may be welded or adhesively attached to back surface 76 of golf club face plate 72. Alternatively and like piston rod 210, piston rod 224 can be adhesively bonded to golf club face plate 72, or threaded and screwed into threaded grooves in golf club face plate 72, or attached using set screws. The mechanism for sealing cylindrical vessels 206 and 220 is not a limitation of the present invention. Other sealing mechanisms that prevent leakage of magneto-rheological fluid from cylindrical assemblies 206 and 220, prevent air from entering cylindrical assemblies 206 and 220, and align the exposed ends of piston rods 210 and 224 may be used.

Although cylindrical vessels 206 and 220 are shown as abutting or frictionally fitting within cavities 104 and 106, this is not a limitation of the present invention. For example, there may be a gap between cavities 104 and 106 and cylindrical vessels 206 and 220, respectively.

Like golf club heads 100 and 150, a cavity 105 is formed in body 102 and a magnet 107 is placed in cavity 105. Magnet 107 creates a magnetic field that interacts with and changes the viscosity of magneto-rheological fluid 212. Thus, magnet 107 can be oriented to either increase or decrease the strength of the portion of the magnetic field that interacts with magneto-rheological fluid 212. In accordance with one embodiment, a cavity 240 is formed in body 102 and a magnet 242 having a ferrite shield 244 is placed in cavity 240. Magnet 242 creates a magnetic field that interacts with and changes the viscosity of magneto-rheological fluid 226. Thus, magnet 242 can be oriented to either increase or decrease the strength of the portion of the magnetic field that interacts with magneto-rheological fluid 226. Although two cavities and two magnets are shown for changing the viscosities of the magneto-rheological fluids, it should be understood this is not a limitation of the present invention. For example, a single magnet may be used to change the viscosities of the magneto-rheological fluids.

In operation, magneto-rheoligical fluids 212 and 226 are tuned to have a desired viscosity by orienting the direction of the magnetic field emanating from magnets 107 and 242, respectively. More particularly, magnet 107 may be oriented to increase or decrease the magnetic field applied to magneto-rheological fluid 212, which in turn increases or decreases its viscosity. Magnet 242 can be oriented to increase or decrease the magnetic field applied to magneto-rheological fluid 226, which in turn increases or decreases the viscosity of magneto-rheological fluid 226. Thus, the clubface response characteristics of each golf club can be adjusted or tuned to those desired by the individual golfer. For example, golfers may find that adjusting magnet 107 to increase the viscosity of magneto-rheological fluid 212 and adjusting magnet 242 to decrease the viscosity of magneto-rheological fluid 226 improves the distance and accuracy of their drives. Once the viscosities are tuned, magnets 107 and 242 are fixed in place to set the desired clubface response characteristics.

By now it should be appreciated that a golf club comprising an golf club head having club face elastically coupled thereto and a method for tuning the golf club have been provided. An advantage of the present invention is that it allows golfers to adjust their clubs for different playing environments, e.g., fast greens, changing from low par to high par golf courses, etc. Another advantage of the present invention is that it allows golfers to adjust their clubs in accordance with the sound made by a golf club when impacting the golf ball. Golfers can use the specific sound quality to determine the quality with which they are striking the golf ball with the golf club. Further, a golf club can be tuned so that it hits a golf ball the same distance independent of where it hits the face of the golf club head, i.e., the golf clubs can be tuned so that golf balls hit by golf clubs at the toe end or heel end of the golf club head travel the same distance as golf balls hit by golf clubs at the center of the face of the golf club head.

Although certain preferred embodiments and methods have been disclosed herein, it will be apparent from the foregoing disclosure to those skilled in the art that variations and modifications of such embodiments and methods may be made without departing from the spirit and scope of the invention. For example, there may be a magnet associated with each shock absorber means, i.e., if there are two structures for absorbing shock, a magnet is associated with each one yield a total of two magnets. It is intended that the invention shall be limited only to the extent required by the appended claims and the rules and principles of applicable law.

What is claimed is:

1. A golf club head comprising:

a body having a front surface, a back surface, a heel end, a toe end, a sole extending between lower portions of the heel and toe ends, a top rail extending between upper portions of the heel and toe ends;

a face elastically coupled to the front surface of the body;

a piston assembly for adjusting shock absorption on the face;

wherein piston assembly comprises:

a cylindrical vessel having first and second ends, the second end having an opening;

a piston disposed within the cylindrical vessel;

a piston rod coupled to the piston;

a seal coupled to the second end; and a rheological fluid disposed in the cylindrical vessel, the theological fluid being contained within the cylindrical vessel by the seal which cooperates wit the second end of the cylindrical vessel and the piston rod.

2. The golf club head of claim 1, wherein the piston assembly further comprises a magnet magnetically coupled to the rheological fluid.

3. The golf club bead of claim 1, further including a coupling plate mounted to the piston rod and attached to the face.

4. The golf club head of claim 1, wherein the theological fluid is selected from a group of rheological fluids including a magneto-rheological fluid and an electro-rheological fluid.

5. A golf club head comprising:

a body having a front surface, a back surface, a heel end, a toe end, a sole extending between lower portions of the heel and toe ends, a top rail extending between upper portions of the heel and toe ends;

a face elastically coupled to the front surface of the body;

a plurality of piston assemblies for adjusting shock absorption on the face;

wherein the plurality of piston assemblies includes a first piston assembly which comprises:

a first cylindrical vessel having first and second ends, the second end having an opening;

a first piston disposed within the first cylindrical vessel;

a first piston rod coupled to the first piston;

a first seal coupled to the second end;

a rheological fluid disposed in the First cylindrical vessel; and wherein a second piston assembly of the plurality of piston assemblies comprises:

a second cylindrical vessel having first and second ends, the second end having an opening;

a second piston disposed within the second cylindrical vessel;

a second piston rod extending from the second piston;

a second seal coupled to the second end; and a rheological fluid disposed in the second cylindrical vessel.

6. The golf club head of claim 5, further including a magnet magnetically coupled to the rheological fluid in the first cylindrical vessel and magnetically coupled to the rheological fluid in the second cylindrical vessel.

7. The golf club head of claim 5, further including a first magnet magnetically coupled to the rheological fluid in the first cylindrical vessel and a second magnet magnetically coupled to the rheological fluid in the second cylindrical vessel.

8. The golf club head of claim 5, further including a first coupling plate mounted to the first piston rod and attached to a first portion of the face and a second coupling plate mounted to the second piston rod, and attached to a second portion of the face.

9. The golf club head of claim 5, wherein the rheological fluid is selected from a group of rheological fluids including a magneto-rheological fluid and an electro-rheological fluid.

10. A golf club head comprising:

a body having a front surface, a back surface, a heel end, a toe end, a sole extending between lower portions of the heel and toe ends, a top rail extending between upper portions of the heel and toe ends;

a face elastically coupled to the front surface of the body;

means for adjusting shock absorption on the face;

wherein the means for adjusting shock absorption comprises a bag containing rheological fluid; and wherein the means for adjusting shock absorption further comprises a magnet magnetically coupled to the rheological fluid in the bag.

11. A golf club head comprising:

a body having a front surface, a back surface, a heel end, a toe end, a face plate, and a dampening structure;

the face plate being adjustably coupled to the body through the dampening structure;

wherein the body has a first cavity extending from the front surface into the body, and wherein the dampening structure comprises:

a piston assembly disposed in the first cavity, the piston assembly including a piston rod;

a theological fluid disposed in the first cavity; and an O-ring assembly coupled to the piston assembly and the first cavity.

12. The golf club head of claim 11, wherein the rheological fluid is selected from a group of rheological fluids including a magneto-rheological fluid and an electro-rheological fluid.

13. The golf club head of claim 11, wherein the body has a second cavity and wherein the dampening structure further comprises a magnet disposed in the second cavity.

* * * * *